United States Patent [19]

Carson, Jr.

[11] 4,213,716

[45] Jul. 22, 1980

[54] RIBBON STRIPPING MECHANISM

[75] Inventor: Andrew B. Carson, Jr., Waynesboro, Va.

[73] Assignee: General Electric Company, Waynesboro, Va.

[21] Appl. No.: 906,112

[22] Filed: May 15, 1978

[51] Int. Cl.[2] ..... B41J 33/10

[52] U.S. Cl. ..... 400/196.1; 400/235.1

[58] Field of Search ..... 400/194, 195, 196.1, 208, 400/235.1, 617

[56] References Cited

U.S. PATENT DOCUMENTS

| | | | |
|---|---|---|---|
| 3,411,686 | 11/1968 | Bender | 400/617 X |
| 3,871,507 | 3/1975 | Perry et al. | 400/196.1 X |
| 3,989,132 | 11/1976 | Carson | 400/195 |
| 4,011,933 | 3/1977 | Kern | 400/235.1 X |
| 4,091,914 | 5/1978 | Stipanuk | 400/196.1 |

OTHER PUBLICATIONS

IBM Technical Disclosure Bulletin, "Print Ribbon Stripper," Chenoweth et al., vol. 13, No. 8, Jan. 1971, p. 2235.

*Primary Examiner*—Ernest T. Wright, Jr.
*Attorney, Agent, or Firm*—Michael Masnik

[57] ABSTRACT

The object of the invention is to provide an effective means of circulating inked ribbon by means of friction rollers into and out of a cartridge where it has been stored as a compact mass of ribbon folds. Means must be provided to prevent this mass of ribbon from being damaged or jammed when it leaves the rollers.

This has been accomplished by introducing a movable stripper which does not frictionally engage the ribbon during its passage through friction rollers but which frictionally engages the ribbon after such passage to move the ribbon away from the friction rollers and thereby minimize scuffing and rubbing action between ribbon and friction rollers.

8 Claims, 6 Drawing Figures

RIBBON STRIPPING MECHANISM

BACKGROUND OF THE INVENTION

This invention relates to inked ribbon cartridges used for storing inked ribbon in random folds in a housing before presenting it for printing and particularly to method and means for facilitating the feeding of such ribbon into a housing storing large quantities of ribbon in random folds.

With the advent of high speed printing, a need has arisen for minimizing ribbon replacement by storing large quantities of inked ribbon in a reservoir or housing at the site where printing is to take place and withdrawing it for printing as needed. One common way for storing inked ribbon is to provide an endless loop of ribbon and storing a substantial portion of it in a housing or reservoir except for that portion needed for immediate printing. It is common practice to confine the ribbon in a cartridge substantially the height of the ribbon such that it stands on edge and to stack the ribbon tightly in random folds in the cartridge. As the ribbon is withdrawn from the cartridge at one point for printing, it is fed back into the cartridge at another point for storage and reuse in printing. A common method for withdrawing ribbon from the outlet end of the reservoir and feeding it to an inlet end is to use pitch rollers. These may take the form of friction rollers for contacting the sides of the ribbon with sufficient pressure to perform the feeding and withdrawing functions without slippage. Reference can be made to U.S. Pat. No. 3,989,132 assigned to the common assignee and filed Aug. 26, 1974 for further details.

As the volume of the ribbon stored in any given reservoir is increased, internal ribbon pressure builds up in the reservoir, slowing the movement of ribbon away from the rollers and thus exposing the ribbon to higher levels of rubbing and scuffing by the rollers for longer periods of time. This not only reduces ribbon life substantially but also increases the likelihood that the ribbon may jam itself by attempting to follow a roller outside of the storage area instead of remaining within the reservoir.

SUMMARY OF THE INVENTION

Accordingly, it is an object of this invention to provide an improved ribbon storage and transport mechanism.

It is a further object of this invention to provide an improved ribbon storage and transport cartridge for use with printing apparatus.

It is a further object of this invention to provide an improved arrangement for stripping restrictive ribbon from the pinch rollers in a ribbon cartridge.

It is a further object of this invention to provide improvements in stuffing an endless ribbon into an elongated reservoir while minimizing damage to the inked ribbon by scuffing and rubbing forces.

It is a further object of this invention to increase the useful life of inked ribbon in a cartridge by facilitating movement of such ribbon into the storage cartridge.

It is a further object of this invention to provide an improved means for feeding ribbon into a cartridge already containing large quantities of ribbon under pressure.

A further object of this invention is to provide an improved ribbon feed arrangement.

DESCRIPTION OF THE PREFERRED EMBODIMENT

Figure 1:
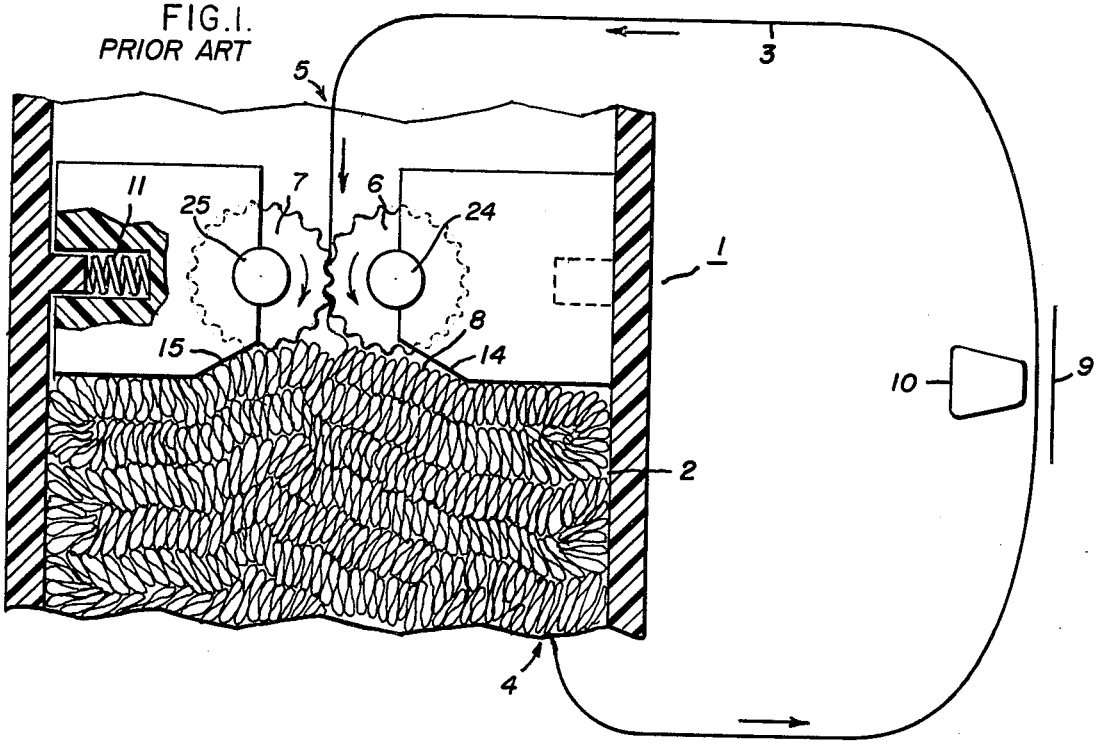
FIG. 1. PRIOR ART
FIG. 1 is a top view of a ribbon cartridge (with its top side cut away) illustrating how ribbon is fed into a cartridge by friction rollers for storage.

Referring now to FIG. 1, the ribbon cartridge 1 includes a relatively elongated rectangular housing shown partially cut away wherein the ribbon 3 is withdrawn from the ribbon cartridge outlet 4 and returned to the cartridge 1 at ribbon inlet opening 5. Power for pulling the ribbon 3 is provided by drive wheel 6 in cooperation with idler wheel 7. The ribbon 3 may be guided to the drive wheel 6 by any well known means such as a guide wheel not shown (see aforementioned U.S. Pat. No. 3,989,132). In leaving drive wheel 6 the ribbon 3 is pushed into the cartridge housing section or storage area 2 where the ribbon 3 arranges or settles itself into upright folds 8. In the open region between outlet opening 4 and inlet opening 5 the ribbon 3 is presented, when mounted on a printer, to the line of a record medium 9 whereby print forming elements carried by a print head 10 cause impact against the ribbon 3 and the record medium 9 under the influence of these elements to form the desired characters. The inked ribbon 3, usually formed of a meshed material such as nylon, retains a supply of printing ink by capillary action and/or absorption. Movement of the ribbon 3 during the printing process is desirable in order to be able to present a different portion of the ribbon 3 for printing each character since with each printing action some of the ink is removed. It is desirable to store a maximum amount of ribbon 3 in the cartridge 1 and effect movement of the stored ribbon 3 with an acceptable amount of ribbon strain. As one increases the density of ribbon 3 in a storage cartridge 1, problems are encountered with ribbon jamming and high ribbon movement forces. U.S. Pat. No. 3,989,132 describes an arrangement for reducing such jamming and ribbon movement forces at the exit.

The present invention is concerned with an additional problem that arises when ribbon 3 is stored in a cartridge 1 in sufficiently large quantities to satisfy high speed printing such as that involved in line printers.

In particular, the present invention is directed to an improved arrangement for stripping ribbon 3 from the pinch rollers, that is, the drive and idler wheels 6 and 7 rotating around shafts 24 and 25, which provide both the pull-in tension and the compressive forces needed to propel the ribbon 3 through the cartridge storage area 2.

To understand the new stripper, it is first necessary to comprehend the problems involved.

FIG. 1 shows an arrangement of pinch rollers and stripper mechanism which is typical of the prior art. There are the pair of rollers (6 and 7) rotating in opposite directions and pressed together by a spring 11. The incoming ribbon 3 is pulled through these rollers 6 and 7 and propelled into the storage area 2 which may be considered to be full of compressed folds of ribbon 3 as shown at 8; a springy mass that exerts considerable back pressure upon the pinch rollers 6 and 7. The rollers 6 and 7 may be hard and toothed as shown or may be smooth and resilient. One or both rollers 6 and 7 may be driven, or one roller may be driven and, in turn, drive the other. Some cartridges use only a single roller, bearing against a spring-loaded wall.

The incoming ribbon 3, being very limber, cannot be forced as a single strand into the compressed mass. The mass, being formed of pleat-like folds, exerts pressure against the pinch rollers 6 and 7, but there is a small triangular area where the ribbon 3 exits from the pinch rollers 6 and 7 which it does not fill (see FIG. 2), and it is into this small area that the incoming single strand of ribbon 3 is injected. Since, in its limber state, it cannot push forward, it impinges on the folded mass, folding against it, thus becoming a part of it.

Figure 2:
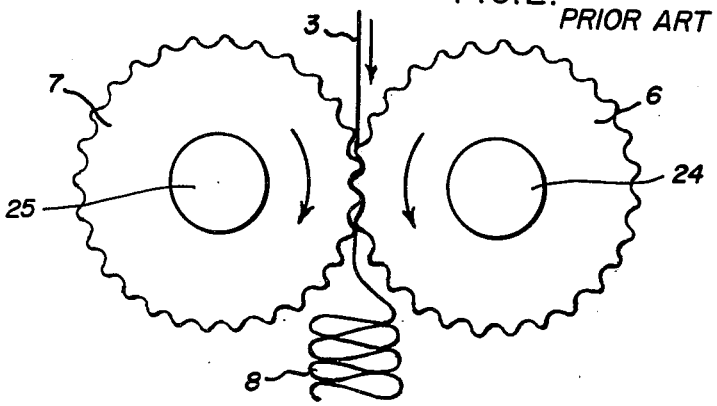
FIG. 2. PRIOR ART
FIG. 2 is an illustration detailing how the ribbon becomes folded or stacked in the cartridge.

Each new fold thus created must immediately make way for a succeeding fold to enter. These folds stack up as shown in FIG. 2. As a stack, or column, the ribbon 3 becomes a solid body which can be pushed, and it is the rubbing and/or scraping action of rollers 6 and 7 against the base of this stack that forces the stack into the compressed mass ahead of it. The stack, of course, moves more slowly than the peripheral speed of the rollers 6 and 7, and considerable abrasion of the ribbon 3 can occur due to this inevitable speed differential.

The entering stack of folded ribbon 3, being opposed by the compressed mass already in the storage area 2, will topple against the exposed portion of the pinch rollers 6 and 7 (first one and then the other) and rides along the surface of one of these rollers 6 and 7 until forced to leave it by the strippers 14 and 15, which frequently serve also as bearings for the rollers 6 and 7.

Figure 3:
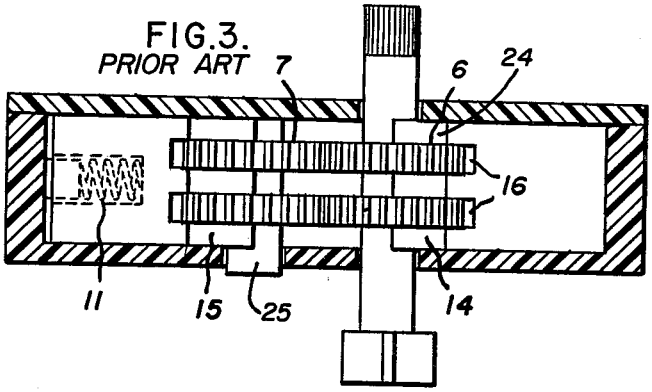
FIG. 3. PRIOR ART
FIG. 3 is a view of the roller mechanism facing the storage reservoir or housing and illustrates the physical spacing between rollers and the strippers or stationary ramps for separating the ribbon from the rollers.

The rollers 6 and 7 are arranged in tiers, usually two (as shown in FIG. 3) or more, and the strippers 14 and 15 comprise stationary ramps which extend into the area between roller tiers, having an inclined plane (ramp) that separates the ribbon 3 from the rollers 6 and 7, forcing it into the storage area 2 instead of allowing it to follow and wind around the rollers 6 and 7.

Figure 4:
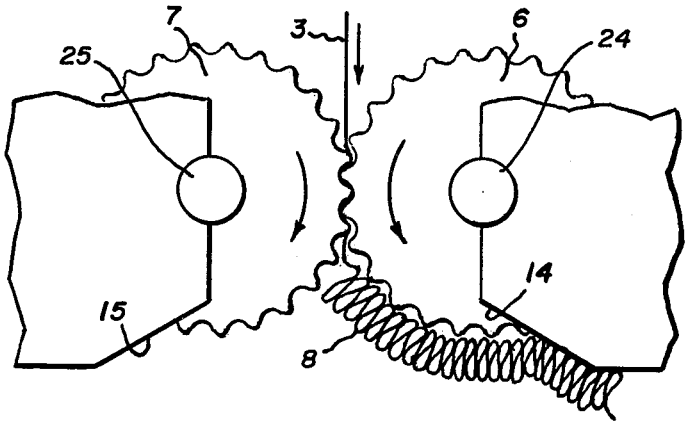
FIG.4. PRIOR ART
FIG. 4 illustrates the problem of ribbon becoming jammed between the roller and stripper.

This action is the source of much trouble. The more densely the ribbon 3 is packed, the greater the back pressure against the rollers 6 and 7 and the greater the reluctance of the ribbon 3 to become separated from the rollers 6 and 7. Sometimes, instead of skidding off the rollers 6 and 7 and onto the ramps 14 and 15, the ribbon 3 will enter the space 16 between the rollers 6 and 7 and the strippers 14 and 15 and cause a jam. There is no known way to completely eliminate this space 16. If the rollers 6 and 7 are toothed, a loose fiber may catch on a tooth and pull the ribbon 3 in. If the rollers 6 and 7 are resilient, the ribbon 3 tends to adhere to and follow the surface of the rollers 6 and 7. The stripping action is shown in more detail in FIG. 4.

If the ramp of the strippers 14 or 15 were made to move in the direction of ribbon flow, the stripping action would be free of sliding, i.e., the ribbon 3 could flow off the rollers 6 and 7 instead of sliding off and would be less apt to follow the rollers 6 or 7 and jam.

Figure 5:
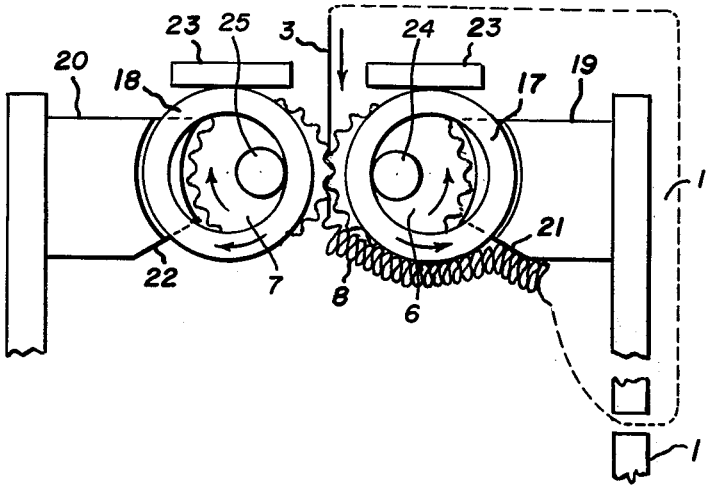
FIG. 5 is a generalized sketch of one embodiment of the invention in which movable strippers are employed to facilitate improved separation of inked ribbon from the friction rollers.

A stripping system of this sort is shown in FIG. 5. The strippers are a set of stripping rings 17, 18 which ride between, above, and below the tiers of pinch rollers 6 and 7. These rings 17 and 18 are supported horizontally in the space between the tiers and by stationary strippers of their own 19, 20. They are free to rotate eccentrically about the axes of shafts 24 and 25 and are driven in rotation primarily by the motion of the ribbon 3 being stripped, in the directions shown. These rotating rings 17 and 18 separate the stacked ribbon 3 from the pinch rollers 6 and 7 gently, with little if any skidding. As the rings 17 and 18 are relatively smooth and moving at ribbon stack speed, there is little tendency for the ribbon 3 to follow the rings 17 and 18 when the ramps 21, 22 of the secondary strippers 19, 20 strip the ribbon 3 from the rings. The rings 17 and 18 stay in the position shown by virtue of the back pressure of the compressed ribbon 3 in the storage area 2 and the restraining presence of bearing surfaces 23 and the shafts 24 and 25 of the pinch rollers 6 and 7.

Figure 6:
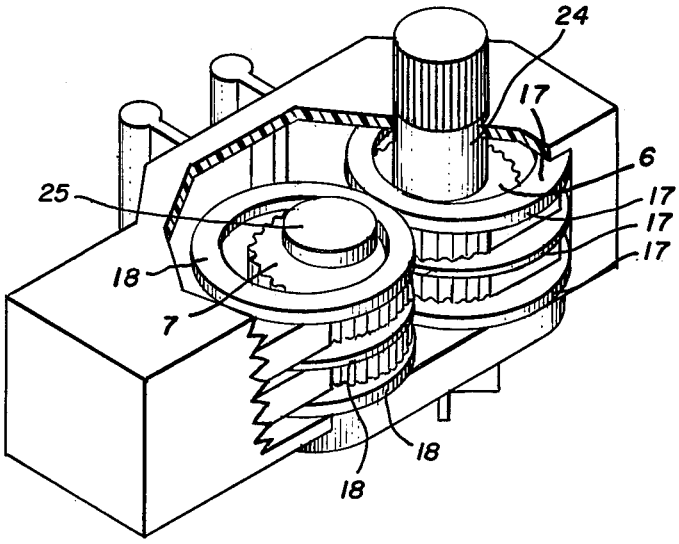
FIG. 6 shows in perspective form a pair of stripping rollers associated with a pair of pinch rollers in accordance with the invention.

FIG. 6 shows a ring stripper assembly using two, two tier pinch rollers 6 and 7 and two sets of three stripping rings 17 and 18. As previously mentioned, an additional advantage of the ring stripper is that it strips the ribbon 3 off the toothed rollers 6 and 7 in a manner that minimizes the scuffing action of the rollers 6 and 7 on the ribbon 3. In this embodiment the pinch rollers 6 and 7 were made of a compressible soft elastomer and the stripping rollers were made of hard, smooth plastic.

The stripper rings 17 and 18 in one embodiment are of rigid material and are free to rotate about their axes. The peripheral surface provides only a light degree of friction with the ribbon 3, preferably just enough to engage the moving ribbon 3 without slippage. In practice the surface finish resulting from normal shop practice in cutting steel rings or molding nylon rings has been quite satisfactory. The surface must not encourage the ribbon 3 to adhere to it lest problems be created in stripping the ribbon 3 from the stripper rings 17 and 18.

In a preferred embodiment the pinch rollers 6 and 7 were made of compressible soft rubber sold under the trade name NBR (acrylonitrile butadiene copolymer) which resists the ink materials in the ribbon 3. The stripping rings 17 and 18 having an inside diameter greater than the diameter of shafts 23 and 24 were of hard, smooth plastic, such as nylon 6-6, and which were arranged to move only when the ribbon 3 presses against the rings 17 and 18.

In the above mentioned embodiment the rings 17 and 18 move at ribbon speed and their movement is not greatly influenced by pinch roller motion. This is not necessarily a rigid requirement. In alternate configurations, the stripper rings 17 and 18 may be independently driven by a belt arrangement or sun-gear arrangements. In these cases the stripper speed would exceed the ribbon mass speed but as long as the surfaces are compatible with the requirements of the preceding paragraphs, no difficulties should be experienced at either the primary or secondary stages of stripping.

There are other possible variations of the present invention, such as positively driving the rings 17 and 18 in sun-gear fashion from the pinch roller shafts 24 and 25 or using belts and auxiliary spindles to provide a moving ramp action.

It will be appreciated that further modifications may be made in the various structures disclosed in order to produce or to carry out the objects of the present invention. Of course, modifications of some of the specific steps cited in describing embodiments of the invention will occur to those skilled in the art. All such modifications which come within the spirit and teachings of this disclosure are intended to be covered by the following claims.

What I claim as new and desire to secure by Letters Patent of the United States is:

1. Means for withdrawing ribbon from an outlet end of a housing and stuffing said ribbon into said housing at an inlet end comprising at least one pair of friction rollers mounted for rotation about respective shafts such that ribbon passing between said rollers is withdrawn from said outlet end and fed into said inlet end by friction of the rollers against the ribbon, means for stripping said ribbon upon passage through said rollers to said outlet end comprising at least one pair of rotatable stripping rings each associated with an associated one of said friction rollers, means for minimizing scuffing and rubbing forces between said friction rollers and said stuffed ribbon comprising the outer diameter of each of said stripping rings being dimensioned to be greater than the outer diameter of its associated friction roller, said stripping rings supported to rotate eccentrically about the axes of the shafts of their associated rollers in the direction of ribbon motion through the friction rollers without touching the ribbon where said ribbon passes between the friction rollers but frictionally engaging said ribbon after said ribbon leaves said rollers.

2. An arrangement according to claim 1 wherein the stripping rings are rotatably driven by the ribbon being fed by the friction rollers to said inlet end.

3. An arrangement according to claim 1 comprising means for rotatably driving said stripping rings.

4. An arrangement according to claims 1, 2 or 3 wherein said stripping rings are of the same outer diameter and the friction rollers are of the same diameter.

5. An arrangement according to claims 1, 2 or 3 wherein the friction rollers are made of a resilient material having a smooth surface for feeding said ribbon to said inlet end and said stripping rings are made of a hard material having a smooth surface for lifting said ribbon from said friction rollers and guiding said ribbon away from said friction rollers.

6. An inked ribbon cartridge for a printing device comprising an endless ribbon, a housing for storing the major portion of said ribbon, a ribbon inlet at one end of said housing and a ribbon outlet at another end of said housing, means comprising at least one friction roller rotating about an axis for withdrawing ribbon under tension from said outlet and for feeding said ribbon to said inlet, said housing having an internal height and length such that incoming ribbon arranges itself into folds without tumbling for causing ribbon to be compressed in said housing, at least one movable stripping ring associated with said at least one friction roller, means for causing said stripping ring to rotate in the direction of ribbon motion without frictionally engaging said ribbon where said ribbon passes between said friction roller but frictionally engaging said ribbon after said ribbon leaves said friction roller comprising means for causing said stripping ring to rotate eccentrically about said axis of said friction roller and the outer diameter of said stripping ring being dimensioned to be greater than the outer diameter of said friction roller.

7. An arrangement according to claim 8 wherein said means for causing said stripping ring to rotate eccentrically comprises a respective bearing surface associated with said stripping ring for positioning said stripping ring with respect to said ribbon after said ribbon leaves said friction rollers.

8. An arrangement according to claims 6 or 7 further comprising a stationary stripper associated with a respective stripping ring to guide the ribbon after said ribbon leaves said stripping ring.

* * * * *